US006822179B1

(12) United States Patent
Huang

(10) Patent No.: US 6,822,179 B1
(45) Date of Patent: Nov. 23, 2004

(54) CIRCUIT BREAKER

(76) Inventor: Albert Huang, 3F, No. 146, Sec. 4, Chungking N. Rd., Taipei (TW)

( * ) Notice: Subject to any disclaimer, the term of this patent is extended or adjusted under 35 U.S.C. 154(b) by 0 days.

(21) Appl. No.: 10/654,316

(22) Filed: Sep. 3, 2003

(51) Int. Cl.[7] ..... H01H 23/00
(52) U.S. Cl. ..... 200/401; 200/339; 200/553
(58) Field of Search ..... 200/400, 401, 200/553, 339, 556, 562; 337/36, 37, 66, 333, 334

(56) References Cited

U.S. PATENT DOCUMENTS 5,828,284 A * 10/1998 Huang ..... 337/37
5,892,426 A * 4/1999 Huang ..... 337/59
5,898,355 A * 4/1999 Yu ..... 337/8
5,936,505 A * 8/1999 Yu ..... 337/37
6,452,125 B1 * 9/2002 Yu ..... 200/553
6,753,491 B1 * 6/2004 Huang ..... 200/400

* cited by examiner

*Primary Examiner*—Anh Mai
*Assistant Examiner*—M. Fishman
(74) *Attorney, Agent, or Firm*—Alan D. Kamrath; Nikolai & Mersereau, P.A.

(57) ABSTRACT

A circuit breaker includes a body having a chamber defined therein. Two terminals are provided in the chamber and extend out from the body. The first terminal has a first node, and the second terminal has a bimetallic strip and a second node on the bimetallic strip and electrically connected with the first node. A reset button is pivotally mounted in the chamber and has a tab formed at a bottom side of and near the first terminal. A swing member has a first pin pivotally mounted in the tab and a second pin under the tab and connected with the first pin by a linkage. An elastic strip is received in the tab and has a leg extending downwards to abut the second pin of the swing member. Even if the reset button is blocked, the bimetallic strip still can deform to terminate the circuit in an excessive-consumption condition.

3 Claims, 5 Drawing Sheets

CIRCUIT BREAKER

BACKGROUND OF THE INVENTION

1. Field of the Invention

The present invention is related to a circuit breaker to automatically terminate an electricity supply in an excessive-demand condition, and more particularly to a circuit breaker which can function even though release of a reset button is blocked.

2. Description of Related Art

For protecting electrical equipment, a circuit breaker is generally used to terminate a supply of electricity when a device connected to the supply starts to draw an excessive amount of electricity.

A conventional circuit breaker is provided with two terminals. A bimetallic strip with a movable node is formed on one of the terminals, and a reset button is attached to the bimetallic strip. In a normal state, the movable node is electrically connected with an immovable node formed on the other terminal. In an excessive-demand condition, the bimetallic strip becomes hot and deforms whereby the movable node is disconnected from the immovable node to switch off the circuit. At the same time, the reset button is pushed by the bimetallic strip to pivot upwards and protrude from a housing. Normally, the protruding reset button is simply pushed by a user whereby the circuit is completed and operation of the electrical device is resumed.

However, in a situation that the reset button is blocked by something, the bimetallic strip cannot deform and the movable node can not be disconnected from the immovable node in the excessive-demand condition and so the circuit cannot be terminated. Such a condition is of course extremely dangerous and will probably result in a fire.

Therefore, the invention provides a circuit breaker to mitigate and/or obviate the aforementioned problems.

SUMMARY OF THE INVENTION

The main objective of the present invention is to provide a circuit breaker which can terminate a circuit in an excessive-demand condition even though release of a reset-button is blocked.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
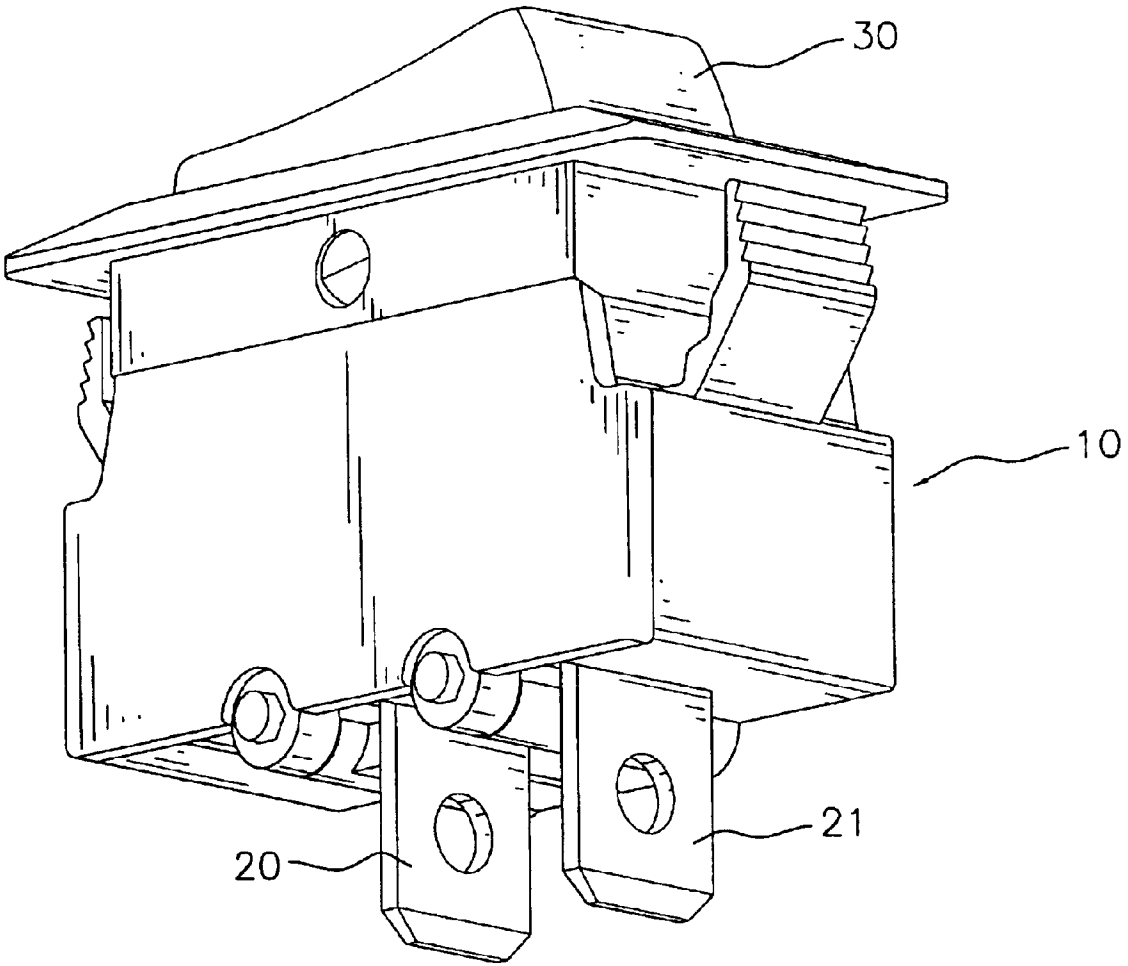
FIG. 1 is a perspective view of a circuit breaker in accordance with the invention.

With reference to FIG. 1, a circuit breaker in accordance with the invention is composed of a body (10), two terminals (20, 21) extending from the body (10), and a reset button (30) pivotally mounted on the body (10).

Figure 2:
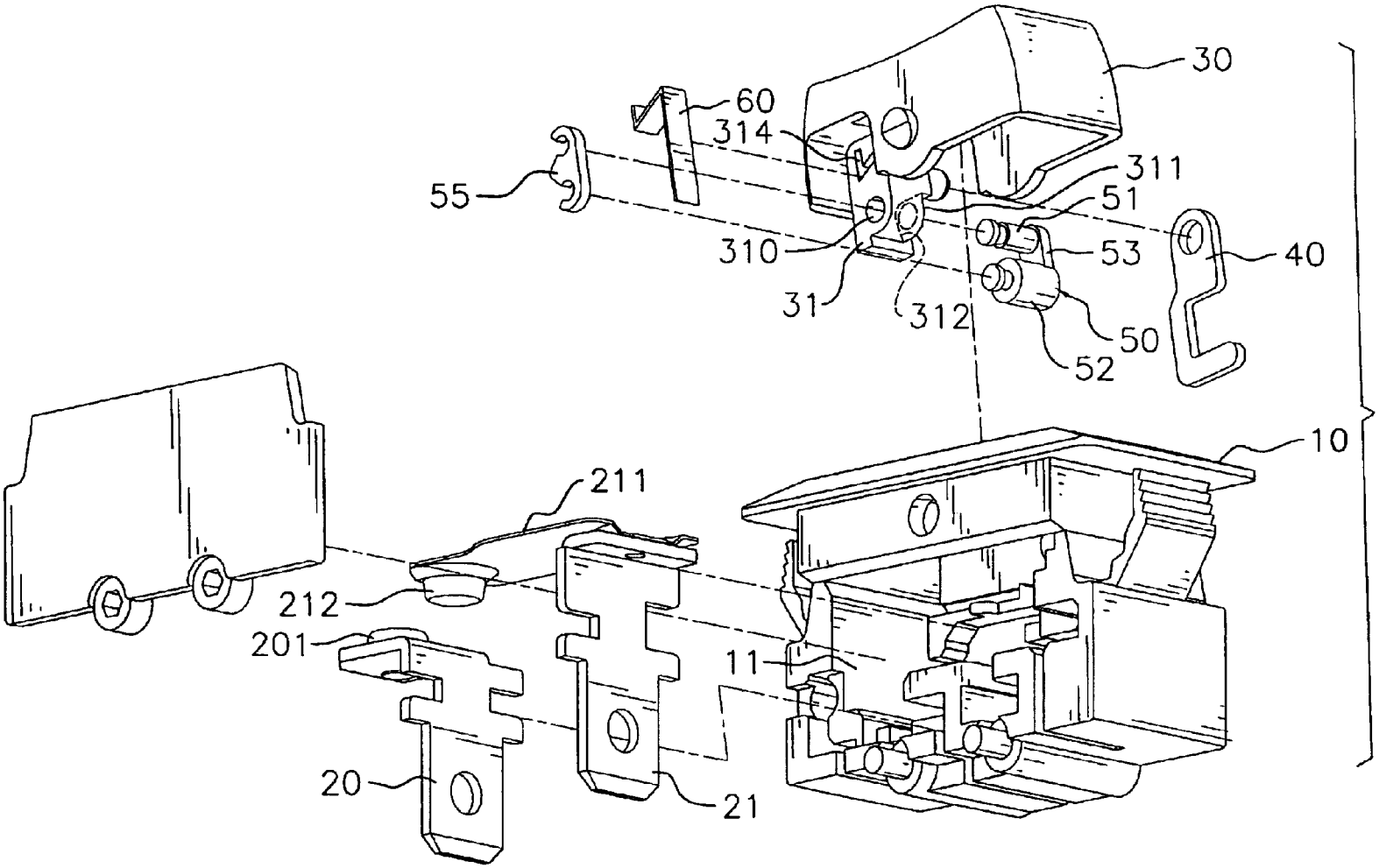
FIG. 2 is an exploded perspective view of the circuit breaker in FIG. 1.

With reference to FIG. 2, a chamber (11) is defined in the body (10). The two terminals (20, 21) are provided in the chamber (11) and extend from a lower side of the chamber (11), wherein the first terminal (20) has an immovable node (201) formed at an upper end thereof, and the second terminal (21) has a bimetallic strip (211) formed at an upper end thereof and extending above the first terminal (20). A movable node (212) is formed at a distal end of the bimetallic strip (211) and aligned with the immovable node (201).

Figure 3:
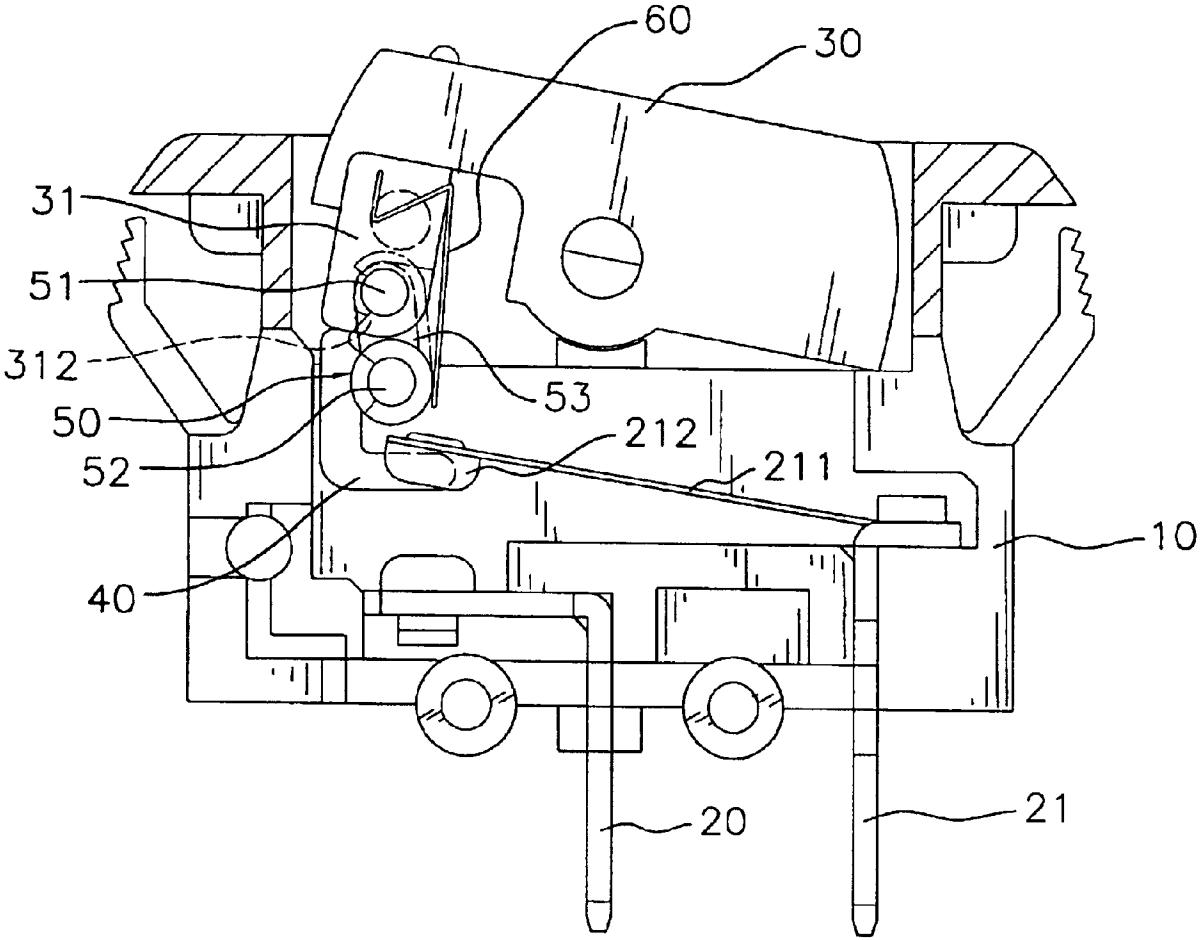
FIG. 3 is a cross sectional view of the circuit breaker in a switched-off state.

The button (30) is pivotally mounted on an upper side of the chamber (11). A tab (31) is formed at a bottom side of the reset button (30) and near the movable node (212). A hook (40) installed on the tab (31) is attached to the distal end of the bimetallic strip (211), as shown in FIG. 3. A user can press the reset button (30) to pull upwards the bimetallic strip (211) by the hook (40) to manually terminate the circuit.

With reference to FIGS. 2 and 3, the tab (31) has a hole (310) transversally defined therethrough, and a swing member (50) is pivotally mounted in the hole (310).

The swing member (50) has a first pin (51) inserted through the hole (310) and a second pin (52) under the tab (31) and parallel to the first pin (51). The first pin (51) and the second pin (52) are connected together at their first ends by a linkage (53), and fastened at their second ends by a fastener (55). Thus, the second pin (52) can be pivoted about the first pin (51).

The tab (31) further has a recess (311) defined at a side facing the linkage (53) for receiving the linkage (53), and a stop (312) is formed at a lower side of the tab (31) to prevent the linkage (53) from pivoting over the stop (312). The tab (3 1) further has an L-like slot (314) defined above the hole (310), and an elastic strip (60) is received in the L-like slot (314) and has a leg (not numbered) extending downwards and pressing the second pin (52) so as to abut the linkage (53) against the stop (312).

FIG. 3 illustrates the circuit breaker in a switched-off state wherein the bimetallic strip (211) is pulled upwards by the hook (40), and the movable node (212) is disconnected from the immovable node (201). Thus, in the excessive-demand of electricity condition and the release of the reset button is unobstructed, the circuit breaker functions normally and the user can reset the circuit by pressing the reset button as described in the following paragraph.

Figure 4:
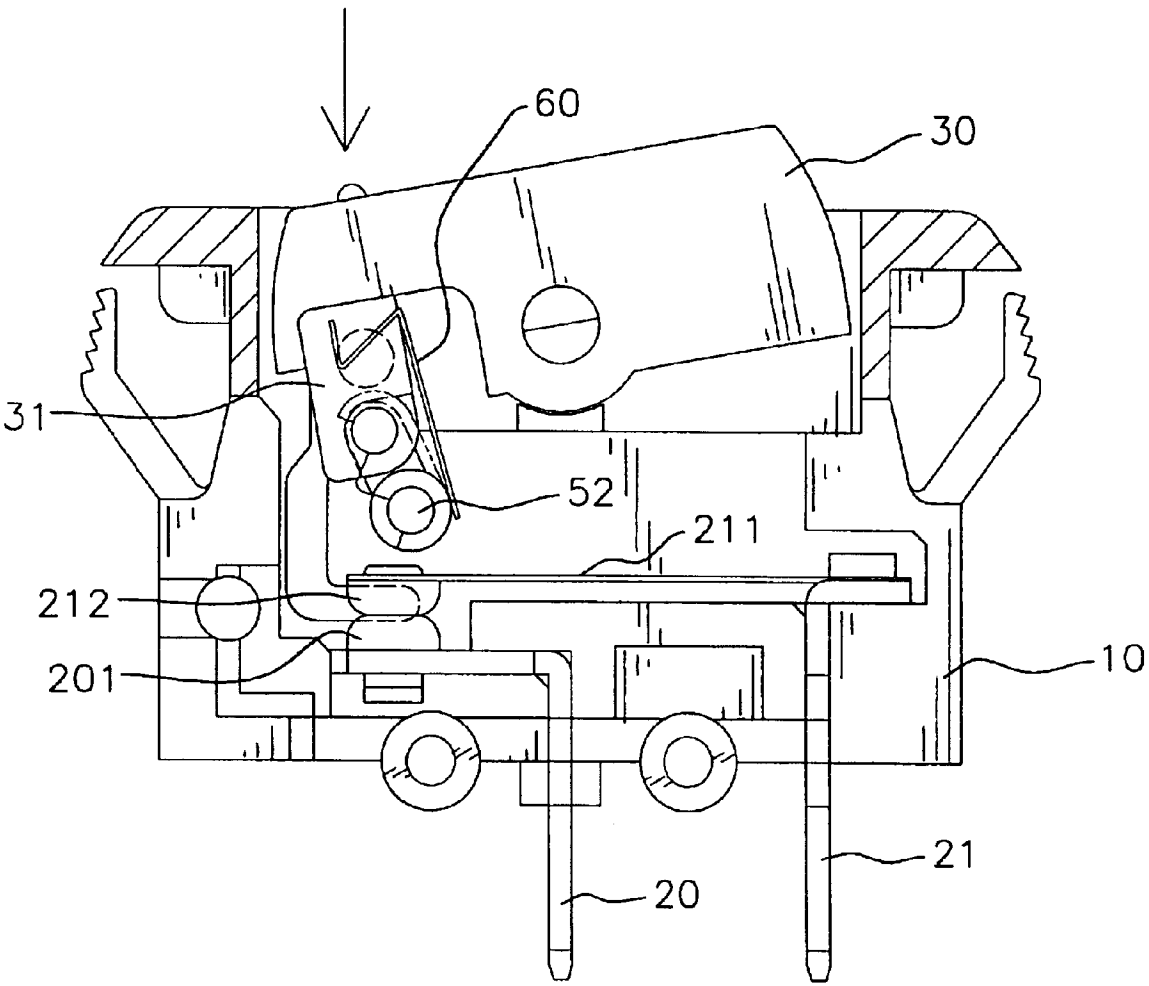
FIG. 4 is a cross sectional view of the circuit breaker in a switched-on state.

With reference to FIG. 4, when the button (30) is pressed to move the tab (31) downwards, the bimetallic strip (211) is pushed downwards by the second pin (52) of the swing member (50) and the movable node (212) is connected with the immovable node (201). In this situation, the swing member (50) is inclinedly disposed above the movable node (212). When the circuit undergoes an excessive-consumption of electricity, the bimetallic strip (211) becomes hot and deforms upwards to disconnect the movable node (212) from the immovable node (201) and to push the swing member (50) upwards and pivot the button (30), as shown in FIG. 3.

Figure 5:
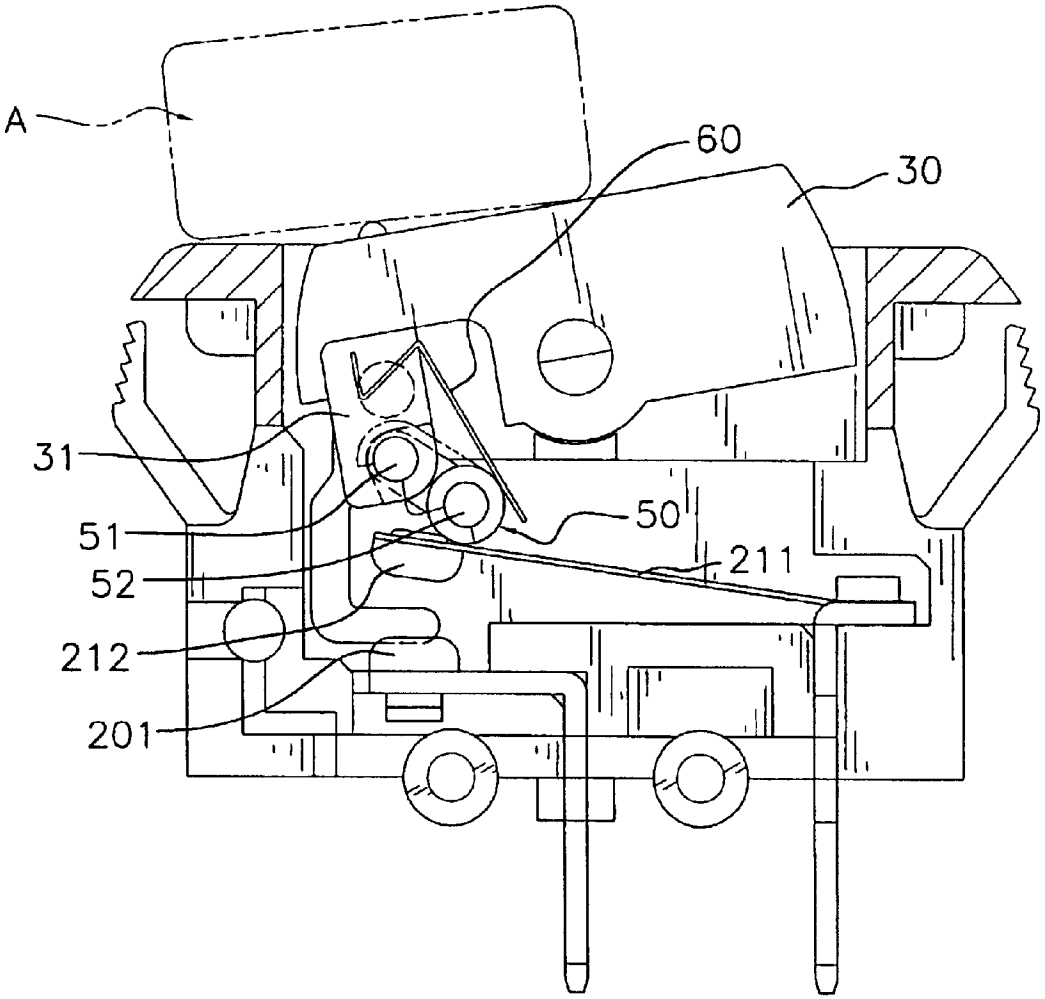
FIG. 5 is a cross sectional view of the circuit breaker in a situation that release of a reset button is blocked.

With reference to FIG. 5, in the situation where the release of the reset button (30) is blocked by an obstruction (A) and cannot be pivoted, when the circuit undergoes excessive consumption of electricity, the bimetallic strip (211) becomes hot and deforms upwards to abut the second pin (52). Due to the release of the reset button (30) being blocked, the second pin (52) is then pivoted upwards about the first pin (51) to allow the movable node (212) of the bimetallic strip (211) to disconnect from the immovable node (201). At the same time, the elastic strip (60) is pressed outwards by the second pin (52). After the obstruction is removed, the reset button (30) can be pressed to move the tab (31) and the swing member (50) upwards. Under the force of the elastic strip (60), the second pin (52) is pivoted downwards to abut the stop (312) again, and the circuit breaker is returned to the switched-off state in FIG. 3.

Therefore, according to the present invention, because the swing member (50) allows the bimetallic strip (212) to deform so as to disconnect the movable node (212) from the immovable node (201) in an excessive-consumption condition, the circuit breaker still has the function to terminate the circuit even if the reset button (30) is blocked.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit breaker comprising:

a body having a chamber defined therein;

two terminals provided in the chamber and extending out of from a bottom of the body, wherein a first of the terminals has a first node formed at an upper end thereof, and a second of the terminals has a bimetallic strip extending above the first terminal and a second node formed at a distal end of the bimetallic strip and electrically connected with the first node in a normal status that the circuit is completed and a device electrically connected in the circuit is switched on;

a reset button pivotally mounted at an upper side of the chamber, the reset button having a tab formed at a bottom side of and near the first terminal;

a swing member having a first pin pivotally mounted in the tab, and a second pin under the tab and connected with the first pin by a linkage; and an elastic strip received in the tab, the elastic strip having a leg extending downwards to abut the second pin of the swing member.

2. The circuit breaker as claimed in claim 1, wherein the tab has a recess defined at a side facing the linkage for receiving the linkage in the recess, and a stop formed at a bottom side; and the linkage abuts the stop under the force of the elastic strip in the normal status.

3. The circuit breaker as claimed in claim 2, wherein the swing member is inclinedly disposed above the first node.

* * * * *